US010060687B2

(12) United States Patent
Wu et al.

(10) Patent No.: US 10,060,687 B2
(45) Date of Patent: Aug. 28, 2018

(54) CONNECTING MEMBER AND MICRO-CHANNEL HEAT EXCHANGER

(71) Applicant: ZHEJIANG DUNAN THERMAL TECHNOLOGY CO., LTD, Shaoxing, Zhejiang (CN)

(72) Inventors: Qinghao Wu, Zhejiang (CN); Jun Jiang, Zhejiang (CN); Dingjun Wang, Zhejiang (CN)

(73) Assignee: ZHEJIANG DUNAN THERMAL TECHNOLOGY CO., LTD, Shaoxing (CN)

( * ) Notice: Subject to any disclaimer, the term of this patent is extended or adjusted under 35 U.S.C. 154(b) by 0 days.

(21) Appl. No.: 15/597,112

(22) Filed: May 16, 2017

(65) Prior Publication Data

US 2018/0003448 A1 Jan. 4, 2018

(30) Foreign Application Priority Data

Jun. 30, 2016 (CN) ..... 2016 1 0531921

(51) Int. Cl.
*F28F 9/26* (2006.01)
*F28D 1/04* (2006.01)
*F28D 1/053* (2006.01)

(52) U.S. Cl.
CPC ..... *F28F 9/26* (2013.01); *F28D 1/0435* (2013.01); *F28D 1/0443* (2013.01); *F28D 1/05383* (2013.01); *F28F 2275/04* (2013.01); *F28F 2275/12* (2013.01)

(58) Field of Classification Search
CPC ..... F28F 9/26; F28D 1/0435; F28D 1/0443
USPC ..... 165/144; 62/498
See application file for complete search history.

(56) References Cited

U.S. PATENT DOCUMENTS 4,926,931 A * 5/1990 Larinoff ..... F28B 1/06 165/111
5,531,268 A * 7/1996 Hoshino ..... F28D 1/0476 165/149
7,921,904 B2 * 4/2011 Matter ..... F28D 1/0417 165/150
9,528,770 B2 * 12/2016 Jiang ..... F28D 1/047
9,752,833 B2 * 9/2017 Gao ..... F28F 1/00
2011/0094257 A1 * 4/2011 Rusignuolo ..... F28D 1/0443 62/498
2012/0279689 A1 * 11/2012 Wang ..... F28D 1/0426 165/144
2013/0098086 A1 * 4/2013 Sillato ..... F25B 49/02 62/184
2013/0292103 A1 * 11/2013 Eindhoven ..... F28B 1/06 165/173

(Continued)

FOREIGN PATENT DOCUMENTS

CN 104713387 A 6/2015

*Primary Examiner* — Raheena R Malik

(57) ABSTRACT

The invention provides a connecting member and a micro-channel heat exchanger. The connecting member comprises a first side plate, a second side plate and an arc-shaped plate connected between the two plates, wherein a plurality of communicating channels (1) which are in parallel with one another and are spaced apart are provided in the connecting member, each of the communicating channels (1) extends from the first side plate to the second side plate. The invention solves the problem that the outer walls of the heat exchange tubes become thin due to bending of the heat exchanger.

16 Claims, 10 Drawing Sheets

(56) References Cited

U.S. PATENT DOCUMENTS

| | | | | |
|---|---|---|---|---|
| 2015/0377559 | A1* | 12/2015 | Csaba | F28F 9/013 165/143 |
| 2016/0169586 | A1* | 6/2016 | Ito | F24F 13/30 165/104.21 |

* cited by examiner

CONNECTING MEMBER AND MICRO-CHANNEL HEAT EXCHANGER

CROSS REFERENCE TO RELATED APPLICATION

This application claims priority to Chinese Patent Application No. 201610531921.X, filed on Jun. 30, 2016, the entire contents of which are incorporated herein by reference.

FIELD OF THE INVENTION

The present invention relates to the technical field of air conditioners, in particular to a connecting member and a micro-channel heat exchanger.

BACKGROUND OF THE INVENTION

Under normal circumstances, common micro-channel heat exchangers are flat and rectangular. However, in order to improve the heat exchange performance and satisfy different application and installation requirements, micro-channel heat exchangers are also manufactured to be in an A-shaped structure.

Due to limitation of dimension of production equipment especially a brazing furnace, micro-channel heat exchangers are usually brazed while passing through the furnace in the form of flat rectangle, and then are bent after completion of brazing to form corresponding bending angles.

Chinese patent application No. 201310681338.3 discloses a bent heat exchanger and a method for bending a heat exchanger. The bent heat exchanger comprises a first header pipe, a second header pipe, a plurality of fins and a plurality of flat pipes, each of the flat pipe comprises a first portion, a second portion and a middle portion which is connected with the first portion and the second portion, the first portion and the second portion are respectively in contact with the fins, the middle portion comprises a first twisting portion connected with the first portion and a flat straight portion connected with the second portion, the flat straight portions of these flat pipes are sequentially and partially overlapped and sequentially and closely adjoined to one another, the flat straight portion comprises an inner surface and an outer surface, and the inner surfaces and outer surfaces of these flat straight portions are flat on the whole. Although this structure can guarantee bending accuracy, since heat exchange tubes are directly bent, consequently outer sides of the bent heat exchange tubes are greatly drawn, outer walls of the heat exchange tubes become thin, the pressure resistance and corrosion resistance are influenced, the tiny channels in the heat exchange tubes are very easily deformed, and the overall performance and the service life of the heat exchanger are influenced.

SUMMARY OF THE INVENTION

The purpose of the present invention is to provide a connecting member and a micro-channel heat exchanger, so as to solve the problems that the outer walls of the heat exchange tubes of the heat exchanger become thin due to bending and the performance and service life of the heat exchanger are influenced.

In order to solve the above-mentioned technical problems, in one aspect of the present invention, the present invention provides a connecting member, comprising a first side plate, a second side plate and an arc-shaped plate connected between the first side plate and the second side plate, wherein a plurality of communicating channels which are in parallel with one another and are spaced apart are provided in the connecting member, each of the communicating channels extends from the first side plate to the second side plate, one or more first heat exchange tube interfaces communicated with the communicating channels are provided in an outer side of the first side plate, and one or more second heat exchange tube interfaces communicated with the communicating channels are provided in an outer side of the second side plate.

The connecting member provided by the present invention is simple in structure, is high in product consistency and facilitates assembling in production; and after the connecting member is applied to a heat exchanger, heat exchange tubes in a plurality of rows can be formed without bending the heat exchange tubes of the heat exchanger, the manufacturing process is simple and the structural stability is good.

The present invention further relates to a micro-channel heat exchanger, comprising heat exchange tubes in a plurality of rows, wherein the heat exchange tubes in the plurality of rows are connected through the connecting member, and the connecting member is connected with the heat exchange tubes and then is bent.

In a specific implementation mode, the connecting member is U-shaped, two sidewalls of the U-shaped connecting member are bent towards inner sides, an included angle between each of the two sidewalls and a U-shaped bottom portion is an acute angle, the heat exchange tubes are provided in two columns and an included angle between the heat exchange tubes in two columns is an acute angle; or two sidewalls of the U-shaped connecting member are bent towards outer sides, an included angle between each of the two sidewalls and a U-shaped bottom portion is an obtuse angle, the heat exchange tubes are provided in two columns and an included angle between the heat exchange tubes in two columns is an obtuse angle.

In a specific implementation mode, the connecting member is line-shaped having an arc-shaped protrusion in middle, the heat exchange tubes are provided in two columns, the heat exchange tubes in two columns are in parallel with each other, and the heat exchange tubes in two columns are respectively connected onto the first heat exchange tube interfaces and the second heat exchange tube interfaces. Preferably, the arc-shaped protrusion outwards protrudes towards a direction far away from the heat exchange tubes or protrudes towards a gap between the heat exchange tubes in two columns.

In a specific implementation mode, the connecting member is line-shaped having an arc-shaped protrusion in middle, the heat exchange tubes are provided in two columns, an obtuse angle is formed between two side plates of the connecting member, an acute angle is formed between the heat exchange tubes in two columns and the arc-shaped protrusion protrudes towards a gap between the heat exchange tubes in two columns.

In a specific implementation mode, the connecting member is line-shaped having an arc-shaped protrusion in middle, the heat exchange tubes are provided in two columns, an obtuse angle is formed between two side plates of the connecting member, an acute angle is formed between the heat exchange tubes in two columns and the arc-shaped protrusion protrudes towards a direction far away from the heat exchange tubes in two columns.

DESCRIPTION OF REFERENCE SIGNS IN DRAWINGS

Figure 1:
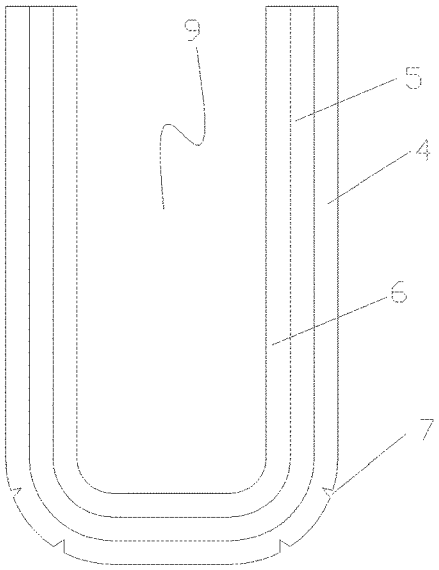
FIG. 1 schematically illustrates a stereoscopic structural view of a connecting member according to embodiment 1 of the present invention.
Figure 2:
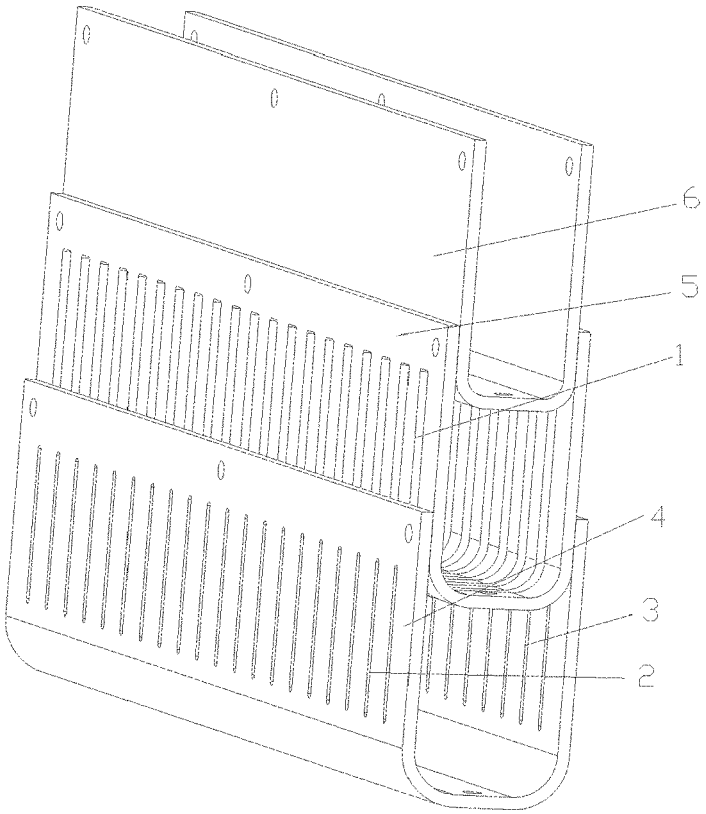
FIG. 2 schematically illustrates an exploded structural view of a connecting member according to embodiment 1 of the present invention.
Figure 3:
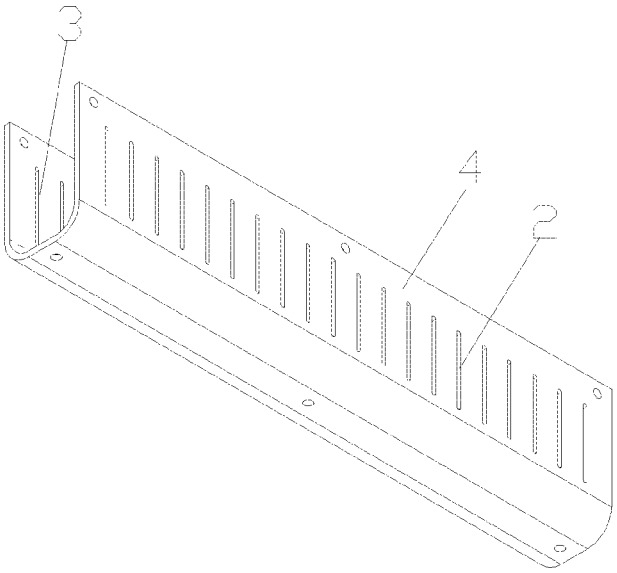
FIG. 3 schematically illustrates a stereoscopic structural view of a first plate member of a connecting member according to embodiment 1 of the present invention.
Figure 4:
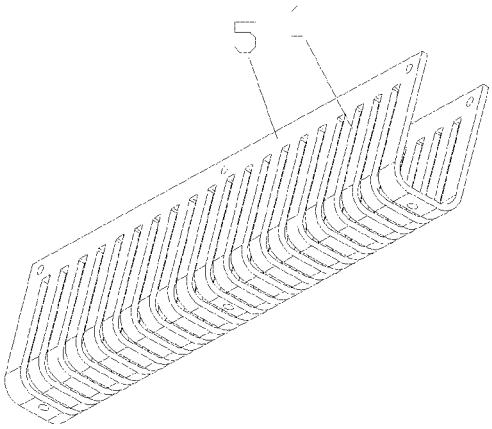
FIG. 4 schematically illustrates a stereoscopic structural view of a second plate member of a connecting member according to embodiment 1 of the present invention.
Figure 5:
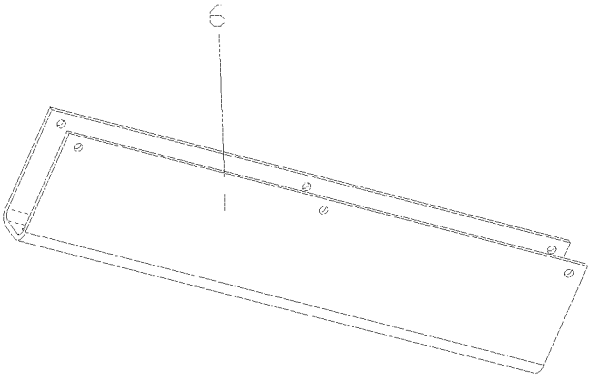
FIG. 5 schematically illustrates a stereoscopic structural view of a third plate member of a connecting member according to embodiment 1 of the present invention.

1—communicating channel; 2—first heat exchange tube interface; 3—second heat exchange tube interface; 4—first plate member; 5—second plate member; 6—third plate member; 7—notch; 8—heat exchange tube; 9—connecting member.

Description of the Embodiments

The embodiments of the present invention will be described below in detail. However, the present invention may be implemented through various different modes defined and covered by claims.

In all following embodiments of the present invention, a first plate member 4 having heat exchange tube interfaces is always considered as the outermost side of a connecting member.

Please refer to FIG. 1-15. According to the embodiment of the present invention, a connecting member comprises a first side plate, a second side plate and an arc-shaped plate connected between the first side plate and the second side plate, a plurality of communicating channels 1 which are in parallel with one another and are spaced apart are provided in the connecting member, each of the communicating channels 1 extends from the first side plate to the second side plate, one or more first heat exchange tube interfaces 2 communicated with the communicating channels 1 are provided in an outer side of the first side plate, and one or more second heat exchange tube interfaces 3 communicated with the communicating channels 1 are provided in an outer side of the second side plate. Preferably, the first heat exchange tube interfaces 2 are correspondingly communicated with the communicating channels 1 one to one, and the second heat exchange tube interfaces 3 are correspondingly communicated with the communicating channels 1 one to one.

The connecting member provided by the present invention is simple in structure, is high in product consistency and facilitates assembling in production; and after the connecting member is applied to a heat exchanger, heat exchange tubes in a plurality of rows can be formed without bending the heat exchange tubes of the heat exchanger, the manufacturing process is simple and the structural stability is good.

As illustrated in FIG. 1-5, according to embodiment of the present invention, the connecting member comprises a first plate member 4, a second plate member 5 and a third plate member 6 which are sequentially overlaid from outside to inside, the first heat exchange tube interfaces 2 and the second heat exchange tube interfaces 3 are respectively provided in two side plates of the first plate member 4, the communicating channels 1 which are sequentially provided in a spaced manner in the second plate member 5 along a length direction, the communicating channels 1 are line-shaped, and the length of the communicating channels 1 is greater than a distance between outer edges of the first heat exchange tube interfaces 2 and the second heat exchange tube interfaces 3 in the first plate member 4. The third plate member 6 is a sealing plate and is hermetically provided on inner sides of the communicating channels 1 in the second plate member 5.

In this embodiment, a section of the connecting member is U-shaped, and the first plate member 4, the second plate member 5 and the third plate member 6 are all U-shaped and are overlaid together to form the connecting member. Side plates, located on a first side, of the first plate member 4, the second plate member 5 and the third plate member 6 are overlaid together to form a first side plate of the connecting member; side plates, located on a second side, of the first plate member 4, the second plate member 5 and the third plate member 6 are overlaid together to form a second side plate of the connecting member, and bottom portions of the U-shaped first plate member 4, second plate member 5 and third plate member 6 are overlaid together to form an arc-shaped plate of the connecting member. Since the three plate members may be respectively manufactured and then are assembled and molded, the molding difficulty of the connecting member can be reduced, the manufacturing efficiency is improved and the manufacturing cost is reduced; and since all plate members of the connecting member are formed of steel plates and the like through bending, the materials are simple and convenient to obtain and the material cost is lower.

The three plate members can be all bent after the three plate members are manufactured, and thereby the manufacturing can be more greatly facilitated.

An inner side surface of the first plate member 4 is fit with an outer side surface of the second plate member 5 and an inner side surface of the second plate member 5 is fit with an inner side surface of the third member 6, such that the three plate members can be closely fit, the connection sealing performance of the three plate members is improved and refrigerant is prevented from leaking from gaps among plate bodies of the three plate members after the refrigerant enters. Coating layers capable of improving leak-proof performance may also be added onto assembling plate surfaces of the three plate members, so as to further improve the sealing performance of the bonding positions of the three plate members. Preferably, the fitting surface is coated with a brazing composite layer or a brazing flux. Automatic brazing may be performed, and after brazing is completed, the sealing performance at the bonding positions of the three plate members can be further improved.

Preferably, the first plate member 4, the second plate member 5 and the third plate member 6 are tightly pressed and fixedly connected through screws or rivets, connecting holes are provided in the first plate member 4, the second plate member 5 and the third plate member 6, bolting or riveting of the three plate members can be facilitated such that the three plate members can be more tightly and firmly connected, and the connecting holes simultaneously play a role of positioning the three plates. The three plate members may also be fixedly connected together by means such as welding.

The outer side surface of the first plate member 4 is coated with a brazing composite layer or a brazing flux. Since the outer side surface of the first plate member 4 and the heat exchange tubes need to be fixedly connected, by coating the brazing composite layer or the brazing flux to the outer side surface of the first plate member 4, the first plate member 4 and the heat exchange tubes can be automatically brazed through a brazing furnace, the molding efficiency is improved, the manufacturing process is simplified and the manufacturing cost is reduced.

The brazing composite layer or the brazing flux may also be coated onto the surfaces, fitting with the connecting member, of the heat exchange tubes.

Preferably, one or more notches 7 are provided in an outer side of a bending position of the arc-shaped plate. The notches 7 are provided in an outer edge of U-shaped bending radius of the arc-shaped plate, such that welding seam leakage is prevented from being caused when the connecting member is bent, and thus the welding quality of the connecting member is improved.

The U-shaped connecting member comprises two side plates and an arc-shaped plate at a bottom portion, and the two side plates and the arc-shaped plate at the bottom portion all have flat surfaces, wherein a relationship between the flat surfaces of the two side plates and the flat surface of the arc-shaped plate at the bottom portion satisfies a condition that the width of the flat surface of the arc-shaped plate at the bottom portion is smaller than or equal to a sum of the width of the flat surfaces of the two side plates, such that the connecting member can be bent into different shapes according to the needs.

When the U-shaped connecting member is manufactured, firstly rough machining is performed to the first plate member 4, the second plate member 5 and the third plate member 6 such that the structures of the three plate members are approximately the same, then the heat exchange tube interfaces are machined in the first plate member 4, the communicating channels are machined in the second plate member 5, the first plate member 4, the second plate member 5 and the third plate member 6 are bent to be U-shaped after machining is completed, and then the three plate members are sequentially overlaid and then are fixedly connected together by means such as welding to form the U-shaped connecting member with end portions being sealed, thereby realizing connection with the heat exchange tubes 8.

In one embodiment which is not illustrated in the drawings, the connecting member comprises a first plate member 4 and a second plate member 5 which are sequentially overlaid from outside to inside, the first heat exchange tube interfaces 2 and the second heat exchange tube interfaces 3 are respectively provided in two side plates of the first plate member 4, the communicating channels 1 which are opened towards the first plate member 4 are sequentially provided in a spaced manner in the second plate member 5 along a length direction, and the thickness of the communicating channels 1 is smaller than the thickness of the second plate member 5. In this embodiment, the second plate member and the third plate member in the above-mentioned embodiment are combined and integrally molded, and finally the first plate member 4 is overlaid to form the U-shaped connecting member.

In another embodiment which is not illustrated in the drawings, the connecting member comprises a first plate member 4 and a second plate member 5 which are sequentially overlaid from outside to inside, the communicating channels 1 which are opened towards the second plate member 5 are provided in one side, close to the second plate member 5, of the first plate member 4, the first heat exchange tube interfaces 2 and the second heat exchange tube interfaces 3 which are respectively located at two ends of the communicating channels 1 and are spaced apart from each other are provided in one side, far away from the second plate member 5, of the first plate member 4, and the first heat exchange tube interfaces 2 and the second heat exchange tube interfaces 3 are all communicated with the communicating channels 1. In this embodiment, the first plate member 4 and the second plate member 5 in embodiment 1 are integrally molded and then are overlaid with the third plate member 6 to form the U-shaped connecting member.

Figure 6:
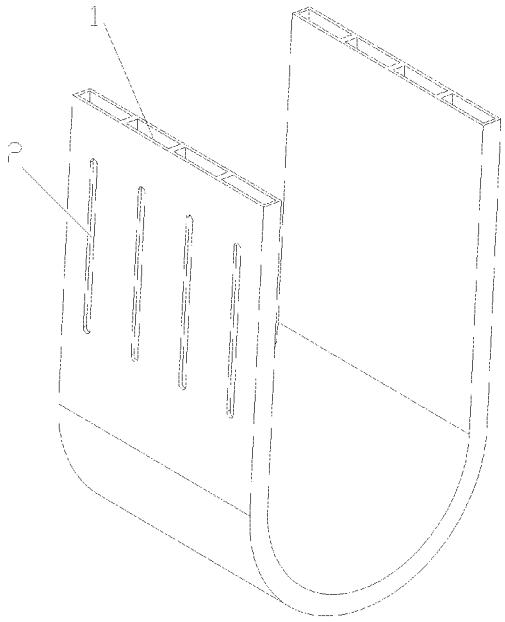
FIG. 6 schematically illustrates a schematic view of another structure of a connecting member according to embodiment 1 of the present invention.

As illustrated in FIG. 6, the connecting member may also be integrally molded through metal extrusion instead of being separately molded and then are fixedly connected together. As compared with the structure that the plate members are separately molded and then are fixedly connected, the integrally molded structure has good sealing performance and structural consistency, and the structural performance is better.

Figure 7:
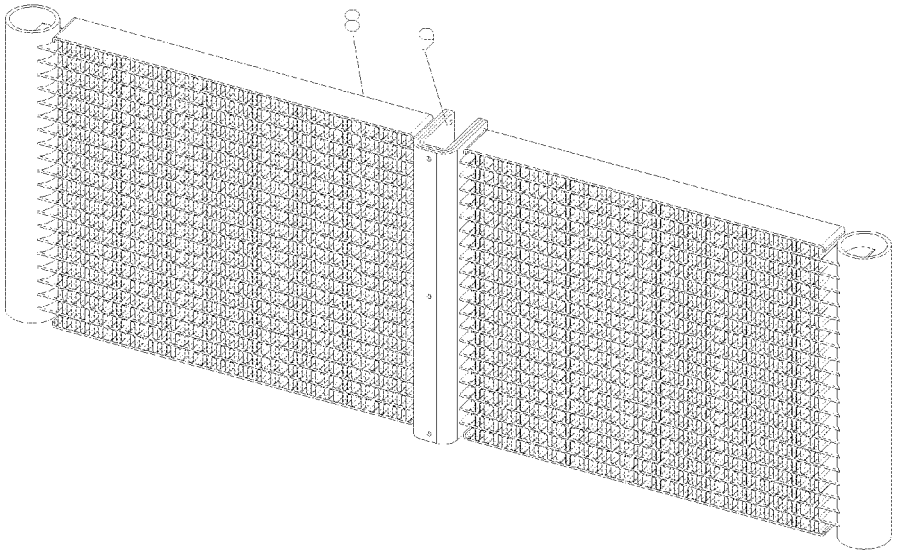
FIG. 7 schematically illustrates a structural schematic view of micro-channel heat exchange tubes before a connecting member is bent according to embodiment 1 of the present invention.
Figure 8:
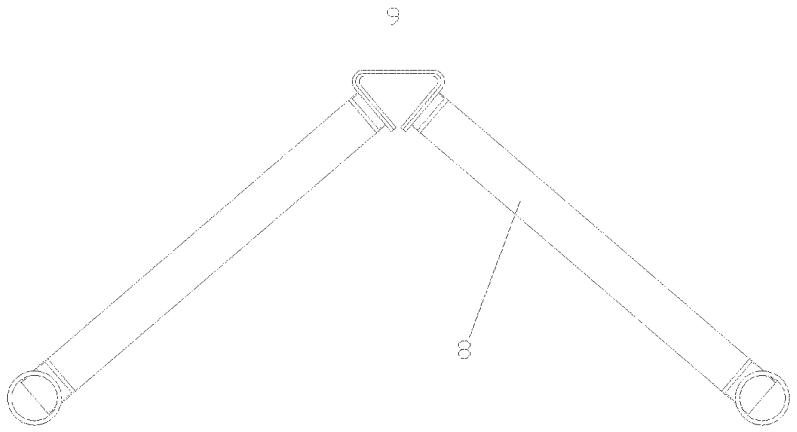
FIG. 8 schematically illustrates a schematic view of a first-type structure of a micro-channel heat exchange tube according to embodiment 1 of the present invention.
Figure 9:
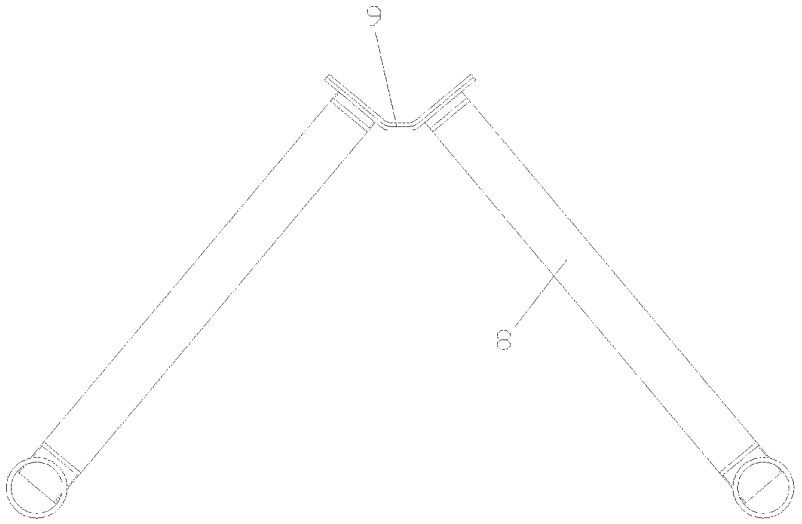
FIG. 9 schematically illustrates a schematic view of a second-type structure of a micro-channel heat exchange tube according to embodiment 1 of the present invention.

As illustrated in FIG. 7-9, a micro-channel heat exchanger according to embodiment 1 of the present invention comprises heat exchange tubes 8 in a plurality of rows, the heat exchange tubes 8 in the plurality of rows are connected through the connecting member 9, and the connecting member 9 is connected with the heat exchange tubes 8 and then is bent.

By taking heat exchange tubes 8 in two rows as an example, when the connecting member 9 is connected onto the heat exchange tubes 8, the connecting member 9 is not bent at this moment and is still U-shaped. After the installation between the heat exchange tubes 8 and the connecting member 9 is completed, two side plates of the U-shaped connecting member are folded towards inner sides, an included angle between each of two side walls and a U-shaped bottom portion is an acute angle, the heat exchange tubes 8 are provided in two columns, and an included angle between the heat exchange tubes 8 in two columns is an acute angle to thereby form a micro-channel heat exchanger illustrated in FIG. 8; and two side plates of the U-shaped connecting member are folded towards outer sides, an included angle between each of two side walls and a U-shaped bottom portion is an obtuse angle, the heat exchange tubes 8 are provided in two columns, and an included angle between the heat exchange tubes 8 in two columns is an obtuse angle to thereby form a micro-channel heat exchanger illustrated in FIG. 9.

When the heat exchanger is bent, preferably the connecting member is inwards bent, i.e., the two side plates of the connecting member are bent towards inner sides such that an included angle between each of the two side plates of the connecting member and a bottom plane of the U-shaped structure is smaller than or equal to 90 degrees, and by using the ductility of metal, the three plate members can be effectively prevented from leaking at welding positions.

In case of bending towards the outer sides, one or more notches may be formed in outer edges of U-shaped bending radium to prevent welding seams from leaking during bending.

Figure 10:
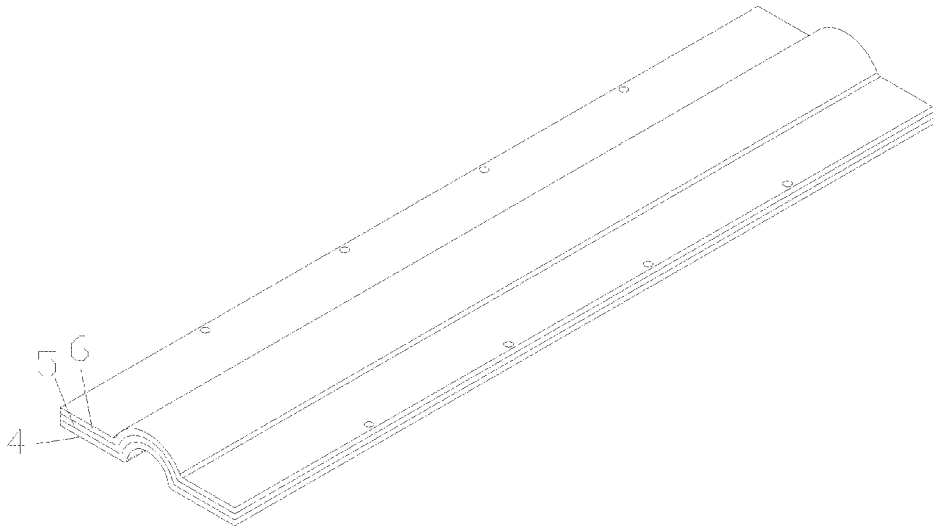
FIG. 10 schematically illustrates a stereoscopic schematic view of a connecting member according to embodiment 2 of the present invention.
Figure 11:
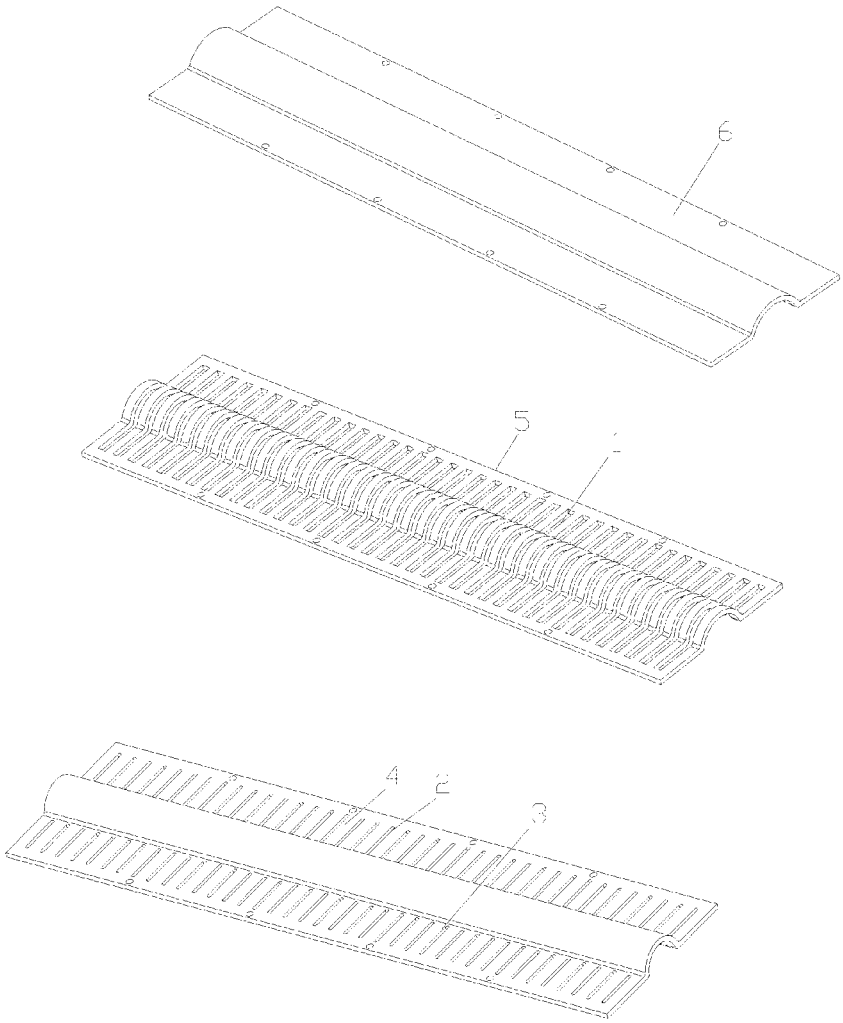
FIG. 11 schematically illustrates an exploded schematic view of a connecting member according to embodiment 2 of the present invention.

As illustrated in FIG. 10 and FIG. 11, according to embodiment 2 of the present invention, the connecting member comprises a first plate member 4, a second plate member 5 and a third plate member 6, the first heat exchange tube interfaces 2 and the second heat exchange tube interfaces 3 are respectively provided in two side plates of the first plate member 4, the communicating channels 1 are sequentially provided in a spaced manner in the second plate member 5 along a length direction, the communicating channels 1 are line-shaped, and the length of the communicating channels 1 is greater than a distance between outer edges of the first heat exchange tube interfaces 2 and the second heat exchange tube interfaces 3 in the first plate member 4. The third plate member 6 is a sealing plate and is hermetically provided on inner sides of the communicating channels 1 in the second plate member 5.

This embodiment is different from embodiment 1 and a specific difference lies in that the two side plates of the connecting member in this embodiment are located on the same plane and are respectively connected to two sides of the arc-shaped plate to thereby form a line-shaped connecting member having an arc-shaped protrusion in middle. Since the connecting member in this embodiment does not need to be bent to be U-shaped, the molding process is simpler, the molding cost is lower and the molding efficiency is higher. After the connecting member in this embodiment is molded, the connecting member may be directly connected with the heat exchange tubes 8 to form a micro-channel heat exchanger with heat exchange tubes 8 in two rows which are in parallel, and the connecting member 9 does not need to be bent any longer.

When the connecting member in this embodiment is molded, the first plate member 4, the second plate member 5 and the third plate member 6 may be respectively manufactured into line-shaped plate structures with consistent sizes and shapes, and the middles of the three line-shaped plate structures all have an arc-shaped protrusion, the first heat exchange tube interfaces and the second heat exchange tube interfaces are further machined in two ends of the first plate member 4, and the communicating channels are further machined in the second plate member 5. After the three plate members are all machined, the three plate members are overlaid together according to different sequences, then seal welding treatment is performed and thereby the line-shaped connecting member having the arc-shaped protrusion in middle can be formed.

When the first plate member 4, the second plate member 5 and the third plate member 6 are overlaid, a protruding direction of the arc-shaped plate is considered as an upward direction, the first plate member 4 may be placed on the topmost layer, the third plate member 6 is placed on the bottommost layer, the first plate member 4 may also be placed on the bottommost layer and the third plate 6 may also be placed on the topmost layer, so as to form different micro-channel heat exchanger structures, together with the heat exchange tubes 8.

Figure 12:
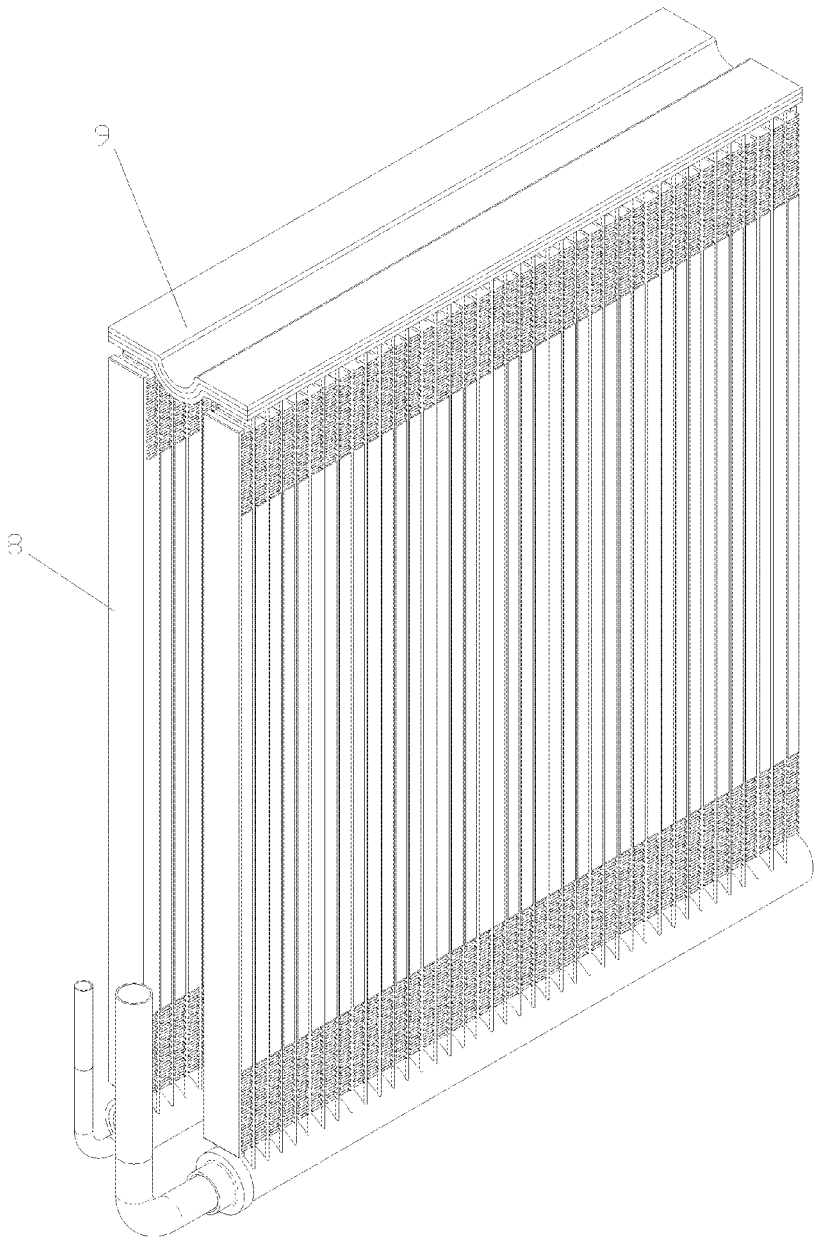
FIG. 12 schematically illustrates a stereoscopic schematic view of a first-type structure of micro-channel heat exchange tubes according to embodiment 2 of the present invention.

As illustrated in FIG. 12, in a first-type structure of the micro-channel heat exchanger provided by the present invention, the first plate member 4 is placed on the topmost layer and the third plate member 6 is placed on the bottommost layer; and after the connecting member 9 and the heat exchange tubes 8 are connected, an obtuse angle is formed between the two side plates of the connecting member 9, an acute angle is formed between the heat exchange tubes 8 in two columns, and the arc-shaped protrusion protrudes towards a gap between the heat exchange tubes 8 in two columns to thereby form a micro-channel heat exchanger structure that the arc-shaped plate is depressed towards the side on which the heat exchange tubes 8 are located.

Figure 13:
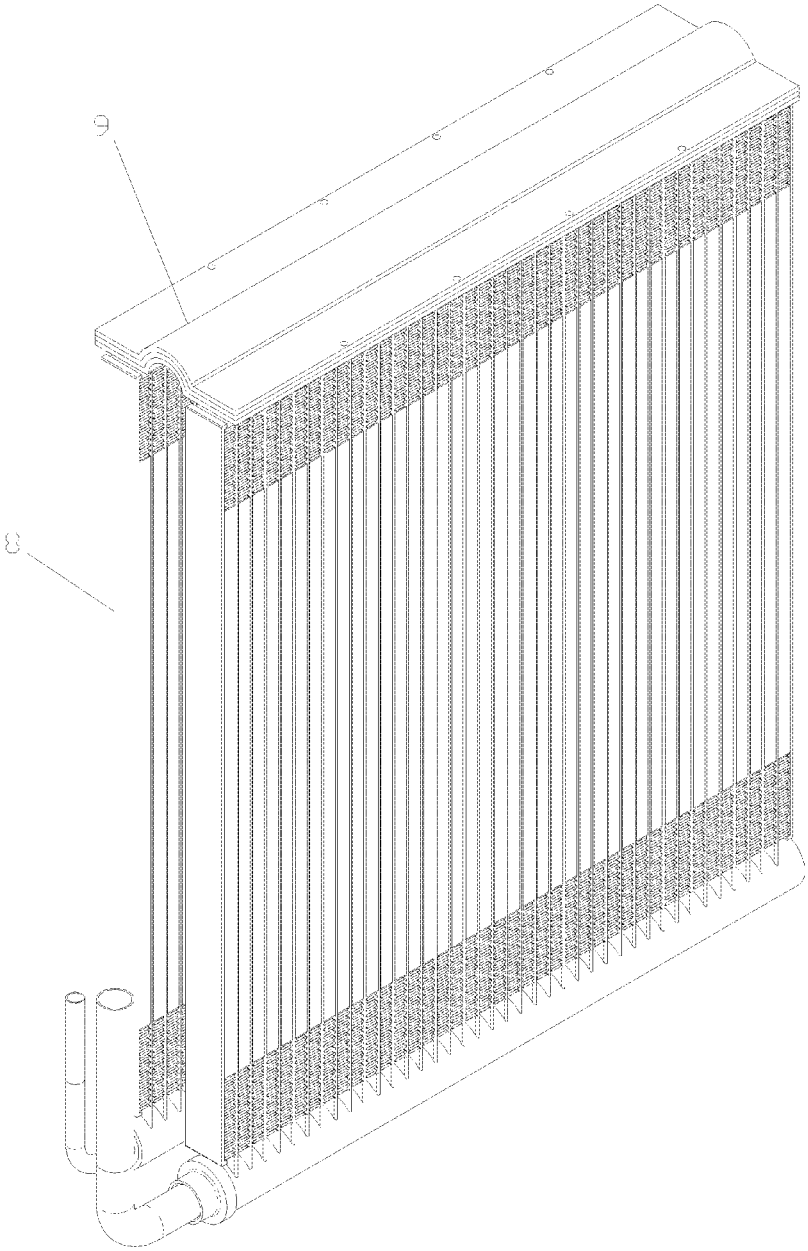
FIG. 13 schematically illustrates a stereoscopic schematic view of a second-type structure of micro-channel heat exchange tubes according to embodiment 2 of the present invention.

As illustrated in FIG. 13, in a second-type structure of the micro-channel heat exchanger provided by the present invention, the first plate member 4 is placed on the bottommost layer and the third plate member 6 is placed on the topmost layer; after the connecting member 9 and the heat exchange tubes 8 are connected, an obtuse angle is formed between the two side plates of the connecting member 9, an acute angle is formed between the heat exchange tubes 8 in two columns, and the arc-shaped protrusion protrudes towards a direction far away from the heat exchange tubes 8 in two columns to thereby form a micro-channel heat exchanger structure that the arc-shaped plate protrudes far away from the side on which the heat exchange tubes 8 are located.

In the two types of structures illustrated in FIG. 12 and FIG. 13, the connecting member 9 is line-shaped having an arc-shaped protrusion in middle, the heat exchange tubes are provided in two columns, the heat exchange tubes 8 in two columns are in parallel with each other, and the heat exchange tubes 8 in two columns are respectively connected to the first heat exchange tube interfaces 2 and the second heat exchange tube interfaces 3. Differences between the two structures lie in that the first plate member 4 in FIG. 12 is located on the outer side of the arc-shaped protrusion, the first plate member 4 in FIG. 13 is located on the inner side of the arc-shaped protrusion, the arc-shaped protrusion in FIG. 12 is depressed towards the side on which the heat exchange tubes 8 are located, and the arc-shaped protrusion in FIG. 13 protrudes far away from the side on which the heat exchange tubes 8 are located. However, with respect to the entire connecting member, the first plate member 4 in any structure is located on the outer side of the connecting member 9.

Figure 14:
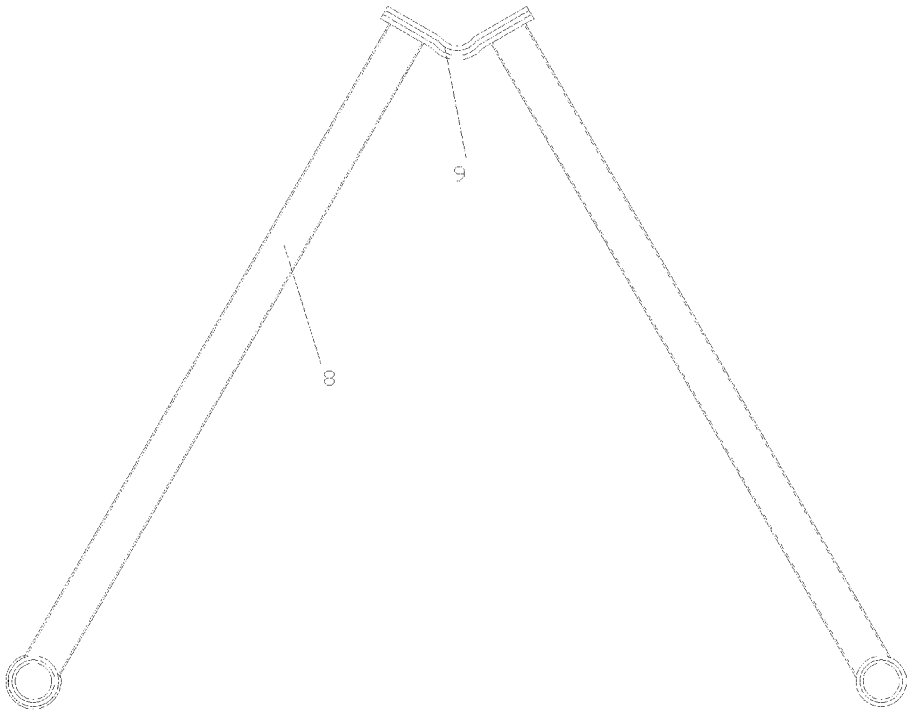
FIG. 14 schematically illustrates a stereoscopic schematic view of a third-type structure of a micro-channel heat exchange tube according to embodiment 2 of the present invention.

As illustrated in FIG. 14, in a third-type structure of the micro-channel heat exchanger provided by the present invention, the first plate member 4 is placed on the topmost layer and the third plate member 6 is placed on the bottommost layer; and after the connecting member 9 and the heat exchange tubes are connected, the two side plates of the connecting member 9 are folded towards inner sides such that the two heat exchange tubes 8 are far away from each other to thereby form an A-shaped micro-channel heat exchanger structure that the arc-shaped plate is depressed towards the side on which the heat exchange tubes 8 are located.

Figure 15:
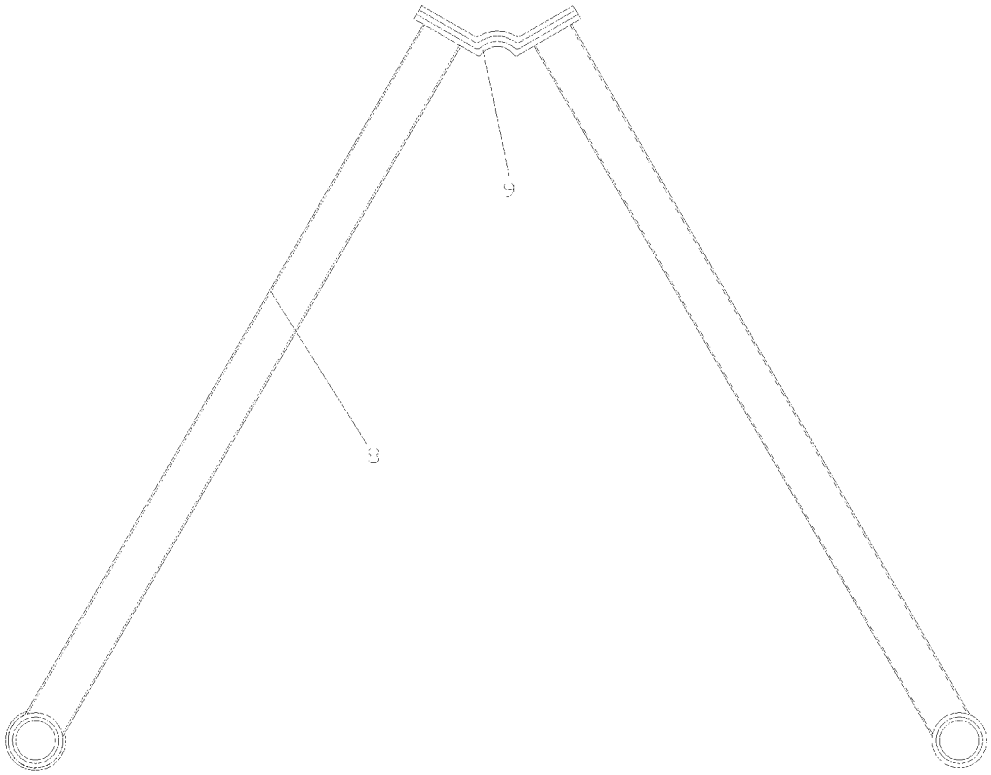
FIG. 15 schematically illustrates a stereoscopic schematic view of a fourth-type structure of a micro-channel heat exchange tube according to embodiment 2 of the present invention.

As illustrated in FIG. 15, in a fourth-type structure of the micro-channel heat exchanger provided by the present invention, the first plate member 4 is placed on the bottom-most layer and the third plate member 6 is placed on the topmost layer; and after the connecting member 9 and the heat exchange tubes are connected, the two side plates of the connecting member 9 are folded towards inner sides such that the two heat exchange tubes 8 are far away from each other to thereby form an A-shaped micro-channel heat exchanger structure that the arc-shaped plate is depressed towards the side on which the heat exchange tubes 8 are located.

The above-mentioned embodiments are just preferred embodiments of the present invention and are not used for limiting the present invention. For one skilled in the art, various modifications and changes can be made to the present invention. Any modification, equivalent replacement, improvement and the like made within the spirit and principle of the present invention shall be all included in the protection scope of the present invention.

The invention claimed is:

1. A connecting member, wherein the connecting member comprises a first side plate, a second side plate and an arc-shaped plate connected between the first side plate and the second side plate, a plurality of communicating channels (1) which are in parallel with one another and are spaced apart are provided in the connecting member, each of the communicating channels (1) extends from the first side plate to the second side plate, each of the first and second side plates has an inner side and an outer side opposite to the inner side, the inner side being closer to an arc center of the arc-shaped plate and the outer side being further away from the arc center of the arc-shaped plate, one or more first heat exchange tube interfaces (2) communicated with the communicating channels (1) are provided in the outer side of the first side plate, and one or more second heat exchange tube interfaces (3) communicated with the communicating channels (1) are provided in the outer side of the second side plate.

2. The connecting member according to claim 1, wherein the connecting member comprises a first plate member (4), a second plate member (5) and a third plate member (6) which are sequentially overlaid from outside to inside, the first heat exchange tube interfaces (2) and the second heat exchange tube interfaces (3) are respectively provided in two side plates of the first plate member (4), the communicating channels (1) which are sequentially provided in a spaced manner in the second plate member (5) along a length direction, and the third plate member (6) is a sealing plate and is hermetically provided on inner sides of the communicating channels (1) in the second plate member (5).

3. The connecting member according to claim 2, wherein an inner side surface of the first plate member (4) is fit with an outer side surface of the second plate member (5) and an inner side surface of the second plate member (5) is fit with an inner side surface of the third member (6).

4. The connecting member according to claim 2, wherein the first plate member (4), the second plate member (5) and the third plate member (6) are tightly pressed and fixedly connected through screws or rivets before brazing.

5. The connecting member according to claim 2, wherein an outer side surface of the first plate member (4) is coated with a brazing composite layer or a brazing flux.

6. The connecting member according to claim 1, wherein one or more notches (7) are provided in an outer side of a bending position of the arc-shaped plate.

7. The connecting member according to claim 1, wherein the connecting member comprises a first plate member (4) and a second plate member (5) which are sequentially overlaid from outside to inside, the first heat exchange tube interfaces (2) and the second heat exchange tube interfaces (3) are respectively provided in two side plates of the first plate member (4), the communicating channels (1) which are opened towards the first plate member (4) are sequentially provided in a spaced manner in the second plate member (5) along a length direction, and the thickness of the communicating channels (1) is smaller than the thickness of the second plate member (5).

8. The connecting member according to claim 1, wherein the connecting member comprises a first plate member (4) and a second plate member (5) which are sequentially overlaid from outside to inside, the communicating channels (1) which are opened towards the second plate member (5) are provided in one side, close to the second plate member (5), of the first plate member (4), the first heat exchange tube interfaces (2) and the second heat exchange tube interfaces (3) which are respectively located at two ends of the communicating channels (1) and are spaced apart from each other are provided in one side, far away from the second plate member (5), of the first plate member (4), and the first heat exchange tube interfaces (2) and the second heat exchange tube interfaces (3) are all communicated with the communicating channels (1).

9. The connecting member according to claim 1, wherein the connecting member is integrally molded through metal extrusion.

10. A micro-channel heat exchanger, comprising heat exchange tubes (8) in a plurality of rows, wherein the heat exchange tubes (8) in the plurality of rows are connected through a connecting member, and the connecting member (9) is connected with the heat exchange tubes (8) and then is bent;

wherein the connecting member comprises a first side plate, a second side plate and an arc-shaped plate connected between the first side plate and the second side plate, a plurality of communicating channels (1) which are in parallel with one another and are spaced apart are provided in the connecting member, each of the communicating channels (1) extends from the first side plate to the second side plate, one or more first heat exchange tube interfaces (2) communicated with the communicating channels (1) are provided in an outer side of the first side plate, and one or more second heat exchange tube interfaces (3) communicated with the communicating channels (1) are provided in an outer side of the second side plate.

11. The micro-channel heat exchanger according to claim 10, wherein the connecting member (9) is U-shaped, two sidewalls of the U-shaped connecting member are bent towards inner sides, an included angle between each of the two sidewalls and a U-shaped bottom portion is an acute angle, the heat exchange tubes (8) are provided in two columns and an included angle between the heat exchange tubes (8) in two columns is an acute angle.

12. The micro-channel heat exchanger according to claim 10, wherein the connecting member (9) is U-shaped, two sidewalls of the U-shaped connecting member are bent towards outer sides, an included angle between each of the two sidewalls and a U-shaped bottom portion is an obtuse angle, the heat exchange tubes (8) are provided in two columns and an included angle between the heat exchange tubes (8) in two columns is an obtuse angle.

13. The micro-channel heat exchanger according to claim 10, wherein the connecting member (9) is line-shaped having an arc-shaped protrusion in middle, the heat exchange tubes are provided in two columns, the heat exchange tubes (8) in two columns are in parallel with each other, and the heat exchange tubes (8) in two columns are respectively connected onto the first heat exchange tube interfaces (2) and the second heat exchange tube interfaces (3).

14. The micro-channel heat exchanger according to claim 13, wherein the arc-shaped protrusion outwards protrudes towards a direction far away from the heat exchange tubes (8) or protrudes towards a gap between the heat exchange tubes (8) in two columns.

15. The micro-channel heat exchanger according to claim 10, wherein the connecting member (9) is line-shaped having an arc-shaped protrusion in middle, the heat exchange tubes are provided in two columns, an obtuse angle is formed between two side plates of the connecting member (9), an acute angle is formed between the heat exchange tubes (8) in two columns and the arc-shaped protrusion protrudes towards a gap between the heat exchange tubes (8) in two columns.

16. The micro-channel heat exchanger according to claim 10, wherein the connecting member (9) is line-shaped having an arc-shaped protrusion in middle, the heat exchange tubes are provided in two columns, an obtuse angle is formed between two side plates of the connecting member (9), an acute angle is formed between the heat exchange tubes (8) in two columns and the arc-shaped protrusion protrudes towards a direction far away from the heat exchange tubes (8) in two columns.

* * * * *